US011436995B2

(12) United States Patent
Shen et al.

(10) Patent No.: US 11,436,995 B2
(45) Date of Patent: Sep. 6, 2022

(54) BACKLIGHT CONTROL SIGNAL DUTY CYCLE EXTENSION SCHEME TO AVOID FLICKER

(71) Applicant: QUALCOMM Incorporated, San Diego, CA (US)

(72) Inventors: Liangguo Shen, San Diego, CA (US); Joseph Dale Rutkowski, Chandler, AZ (US); Sugato Mukherjee, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/928,634

(22) Filed: Jul. 14, 2020

(65) Prior Publication Data

US 2022/0020338 A1 Jan. 20, 2022

(51) Int. Cl.
*G09G 5/10* (2006.01)

(52) U.S. Cl.
CPC ..... *G09G 5/10* (2013.01); *G09G 2300/0857* (2013.01); *G09G 2310/0297* (2013.01); *G09G 2320/0247* (2013.01); *G09G 2320/0626* (2013.01); *G09G 2330/021* (2013.01)

(58) Field of Classification Search
None
See application file for complete search history.

(56) References Cited

U.S. PATENT DOCUMENTS

2013/0162701 A1* 6/2013 Yang ..... G09G 3/3406 345/691
2016/0143103 A1* 5/2016 Kang ..... G09G 3/3406 315/210
2017/0208661 A1* 7/2017 Hussain ..... H05B 45/38

* cited by examiner

*Primary Examiner* — Amr A Awad
*Assistant Examiner* — Donna V Bocar
(74) *Attorney, Agent, or Firm* — Patterson & Sheridan, LLP

(57) ABSTRACT

Certain aspects are directed to a circuit for brightness control. The circuit generally includes: a duty cycle adjustment circuit configured to receive a first backlight control signal having a first duty cycle and generate a second backlight control signal having a second duty cycle, the second duty cycle being greater than the first duty cycle if the first duty cycle is less than a threshold; a digital processor configured to set a value of a software brightness code based on the second duty cycle; and a backlight control circuit configured to drive a backlight in accordance with the software brightness code and the second duty cycle of the second backlight control signal.

20 Claims, 5 Drawing Sheets

BACKLIGHT CONTROL SIGNAL DUTY CYCLE EXTENSION SCHEME TO AVOID FLICKER

TECHNICAL FIELD

Certain aspects of the present disclosure generally relate to electronic circuits and, more particularly, to backlight control circuitry.

BACKGROUND

A backlight for a display may be set to a brightness that allows for full illumination of a white pixel. In some implementations, a content adaptive backlight control (CABC) signal may be used to automatically dim the backlight to the lowest level demanded to fully illuminate the brightest pixel on the display, reducing power consumption. A controller may then be used to lighten the image to be displayed such that there is little to no visible change in the image, but less power is used in the backlight for any image that does not contain a pure white pixel. In this manner, CABC may be used to reduce the overall power consumption of a display. CABC has also been widely used by various smartphone original equipment manufacturers (OEMs) to dynamically adjust display brightness.

SUMMARY

Certain aspects are directed to a circuit for brightness control. The circuit generally includes: a duty cycle adjustment circuit configured to receive a first backlight control signal having a first duty cycle and generate a second backlight control signal having a second duty cycle, the second duty cycle being greater than the first duty cycle if the first duty cycle is less than a threshold; a digital processor configured to set a value of a software brightness code based on the second duty cycle; and a backlight control circuit configured to drive a backlight in accordance with the software brightness code and the second duty cycle of the second backlight control signal.

Certain aspects are directed to a method for brightness control. The method generally includes: receiving, via a duty cycle adjustment circuit, a first backlight control signal having a first duty cycle; generating, via the duty cycle adjustment circuit, a second backlight control signal having a second duty cycle, the second duty cycle being greater than the first duty cycle if the first duty cycle is less than a threshold; setting, via a digital processor, a value of a software brightness code based on the second duty cycle; and driving, via a backlight control circuit, a backlight in accordance with the software brightness code and the second duty cycle of the second backlight control signal.

Certain aspects are directed to an apparatus for brightness control. The apparatus generally includes: means for receiving a first backlight control signal having a first duty cycle; means for generating a second backlight control signal having a second duty cycle, the second duty cycle being greater than the first duty cycle if the first duty cycle is less than a threshold; means for setting a value of a software brightness code based on the second duty cycle; and means for driving a backlight in accordance with the software brightness code and the second duty cycle of the second backlight control signal.

Certain aspects are directed to a computer-readable medium having instructions stored thereon to cause a processor to: generate, via a duty cycle adjustment circuit configured to receive a first backlight control signal having a first duty cycle, a second backlight control signal having a second duty cycle, the second duty cycle being greater than the first duty cycle if the first duty cycle is less than a threshold; set, via the processor, a value of a software brightness code based on the second duty cycle; and drive, via a backlight control circuit, a backlight in accordance with the software brightness code and the second duty cycle of the second backlight control signal.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

Certain aspects of the present disclosure generally relate to techniques for content adaptive backlight control (CABC). For example, a duty cycle of a CABC may be increased to avoid quantization errors that may result in visible display flicker, as described in more detail herein.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects.

As used herein, the term "connected with" in the various tenses of the verb "connect" may mean that element A is directly connected to element B or that other elements may be connected between elements A and B (i.e., that element A is indirectly connected with element B). In the case of electrical components, the term "connected with" may also be used herein to mean that a wire, trace, or other electrically conductive material is used to electrically connect elements A and B (and any components electrically connected therebetween).

Figure 1:
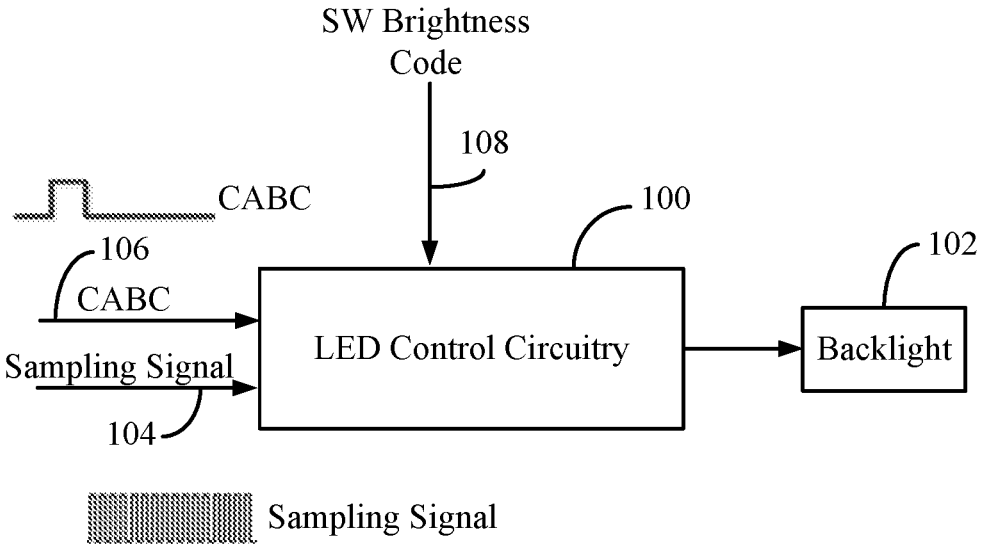
FIG. 1 illustrates a backlight control circuit, in accordance with certain aspects of the present disclosure.

FIG. 1 illustrates a backlight (e.g., light-emitting diode (LED)) control circuit 100, in accordance with certain aspects of the present disclosure. The backlight control circuit 100 may receive a digital signal, referred to as a software (SW) brightness code 108. The backlight control circuit 100 may set a brightness level of a display (e.g., backlight 102 such as a white LED (WLED) of a display) based on the SW brightness code. In some cases, the backlight control circuit 100 may also receive a content adaptive backlight control (CABC) signal 106. The CABC signal 106 may be a pulse-width modulated (PWM) input signal that may be received from a display driver integrated circuit (DDIC), for example. A duty cycle of the CABC signal 106 may be set to modulate current to the backlight 102 to achieve a certain brightness level for CABC dimming. The CABC duty cycle may be programmed from 0.1% up to 100%. In other words, the backlight control circuit 100 sets the current to the backlight 102 of the display based on both the duty cycle of the CABC signal 106 and the SW brightness code 108. For instance, the product of the CABC duty cycle and the SW brightness code may set the brightness level of the backlight 102.

The backlight control circuit 100 may receive a sampling signal 104 having a higher frequency than the frequency of the CABC signal 106, as illustrated. The sampling signal 104 may be used to sample the CABC signal 106, in effect determining the duty cycle of the CABC signal 106 to set the brightness of the backlight 102. However, the CABC signal 106 and the sampling signal 104 may not be synchronized, which may typically result in a quantization error when determining the duty cycle of the CABC signal. This quantization error gets worse as the duty cycle of the CABC signal 106 decreases. For example, once the duty cycle of the CABC signal reaches a certain threshold, a flicker may become visible at the display, adversely impacting customer satisfaction. Certain aspects of the present disclosure are generally directed to increasing a duty cycle of the CABC signal while still configuring a desired brightness level for the display using the SW brightness code.

Figure 2:
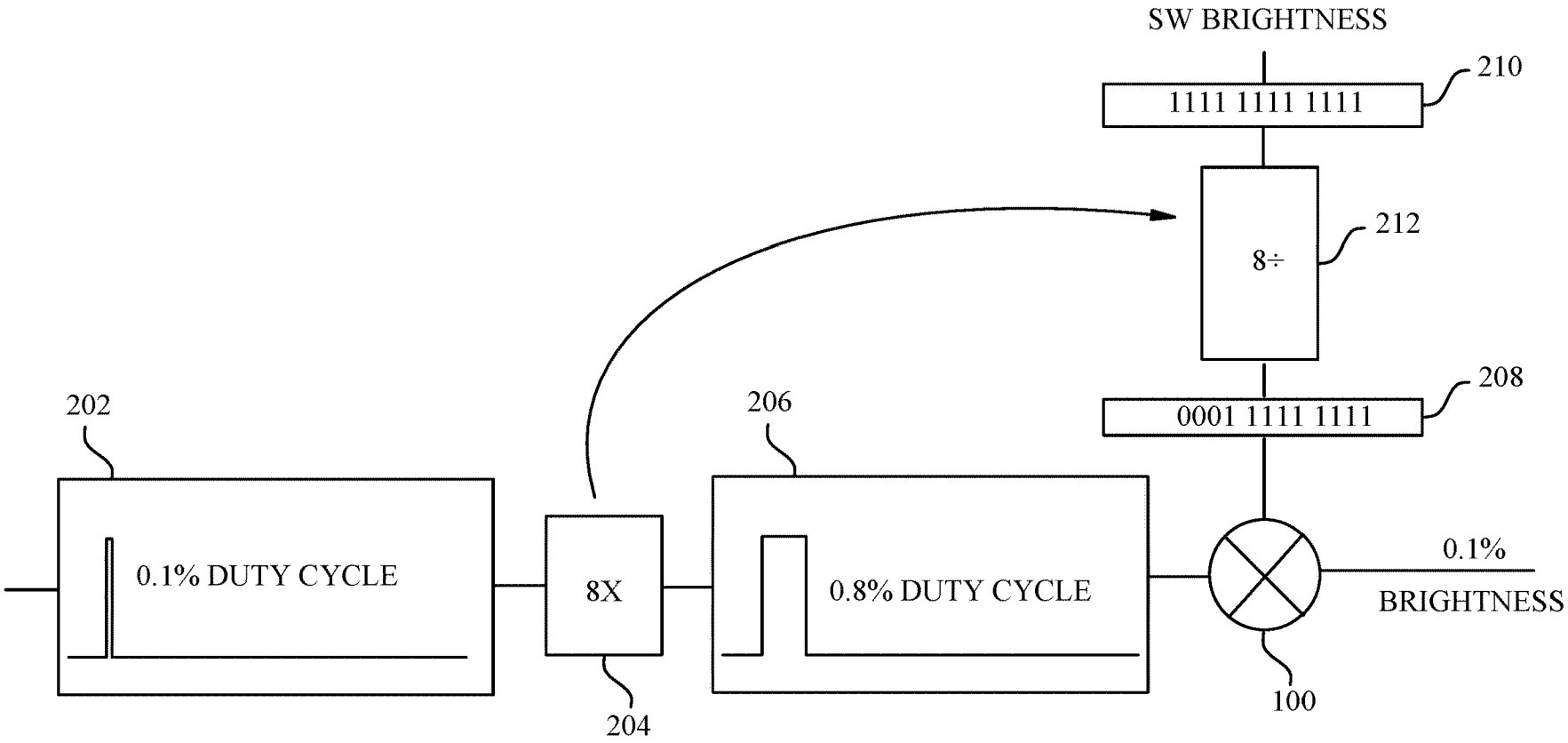
FIG. 2 illustrates circuitry for adjusting a duty cycle of a backlight control signal, in accordance with certain aspects of the present disclosure.

FIG. 2 illustrates circuitry for adjusting a duty cycle of a CABC signal, in accordance with certain aspects of the present disclosure. For example, a duty cycle adjustment circuit 204 may receive a CABC signal 202 having a duty cycle of 0.1%. The duty cycle adjustment circuit 204 may generate a stretched CABC (CABC_stretch) signal by increasing the duty cycle associated with the CABC signal 202 by a duty cycle adjustment factor (e.g., a factor of 8, in this example). For example, the duty cycle adjustment circuit 204 may generate the stretched CABC signal 206 having a duty cycle of 0.8%, as illustrated.

To compensate for the increase in the duty cycle of the CABC signal 206, a SW brightness code 210 used to set the brightness of the display may be divided by a code adjustment factor, the code adjustment factor corresponding to the duty cycle adjustment factor. For example, a digital processor 212 may divide the SW brightness code 210 by 8, generating an adjusted SW brightness code 208. The stretched CABC signal 206 (e.g., corresponding to CABC signal 106) and the adjusted SW brightness code 208 (e.g., corresponding to SW brightness code 108) may be provided to the backlight control circuit 100 for generating the current to the backlight 102, as described with respect to FIG. 1. As illustrated, while the duty cycle of the CABC signal 206 is increased from 0.1% to 0.8%, the brightness level of the display may be maintained at 0.1% due to the reduction of the SW brightness code.

Figure 3:
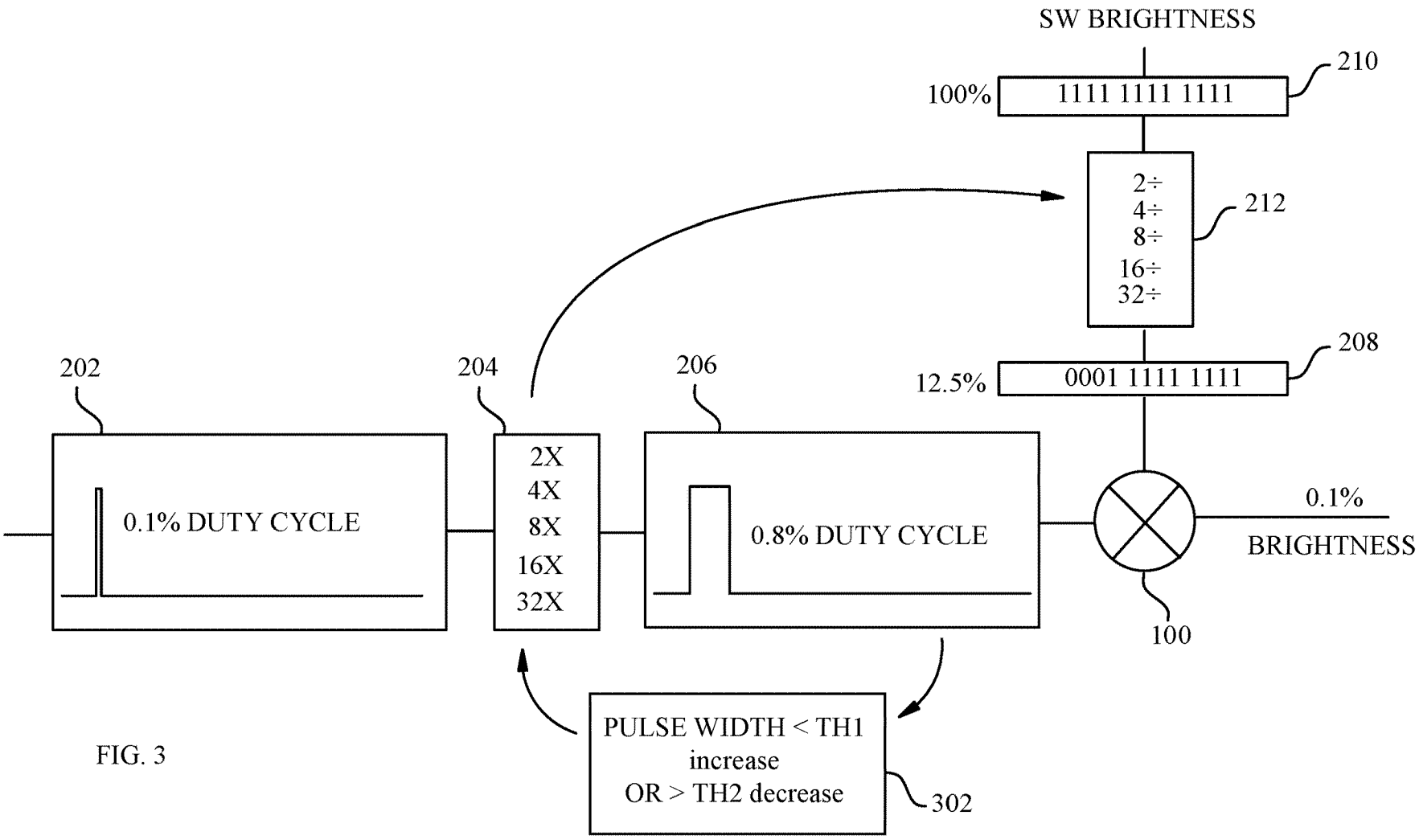
FIG. 3 is a block diagram illustrating example circuitry having a feedback path for setting a duty cycle adjustment factor, in accordance with certain aspects of the present disclosure.

FIG. 3 is a block diagram illustrating example circuitry having a feedback path for setting the duty cycle adjustment factor, in accordance with certain aspects of the present disclosure. For example, a control circuit 302 may receive the adjusted CABC signal 206 and compare a pulse width of the adjusted CABC signal to one or more thresholds. For example, if the pulse width of the adjusted CABC signal is less than a first threshold (TH1), the control circuit 302 may control the duty cycle adjustment circuit 204 to increase the duty cycle adjustment factor (e.g., from 4 to 8), and if the pulse width of the adjusted CABC signal is greater than a second threshold (TH2), the control circuit 302 may control the duty cycle adjustment circuit 204 to decrease the duty cycle adjustment factor (e.g., from 16 to 8). The control circuit 302 and the digital processor 212 may be part of the same digital processor, in some aspects.

Figure 4:
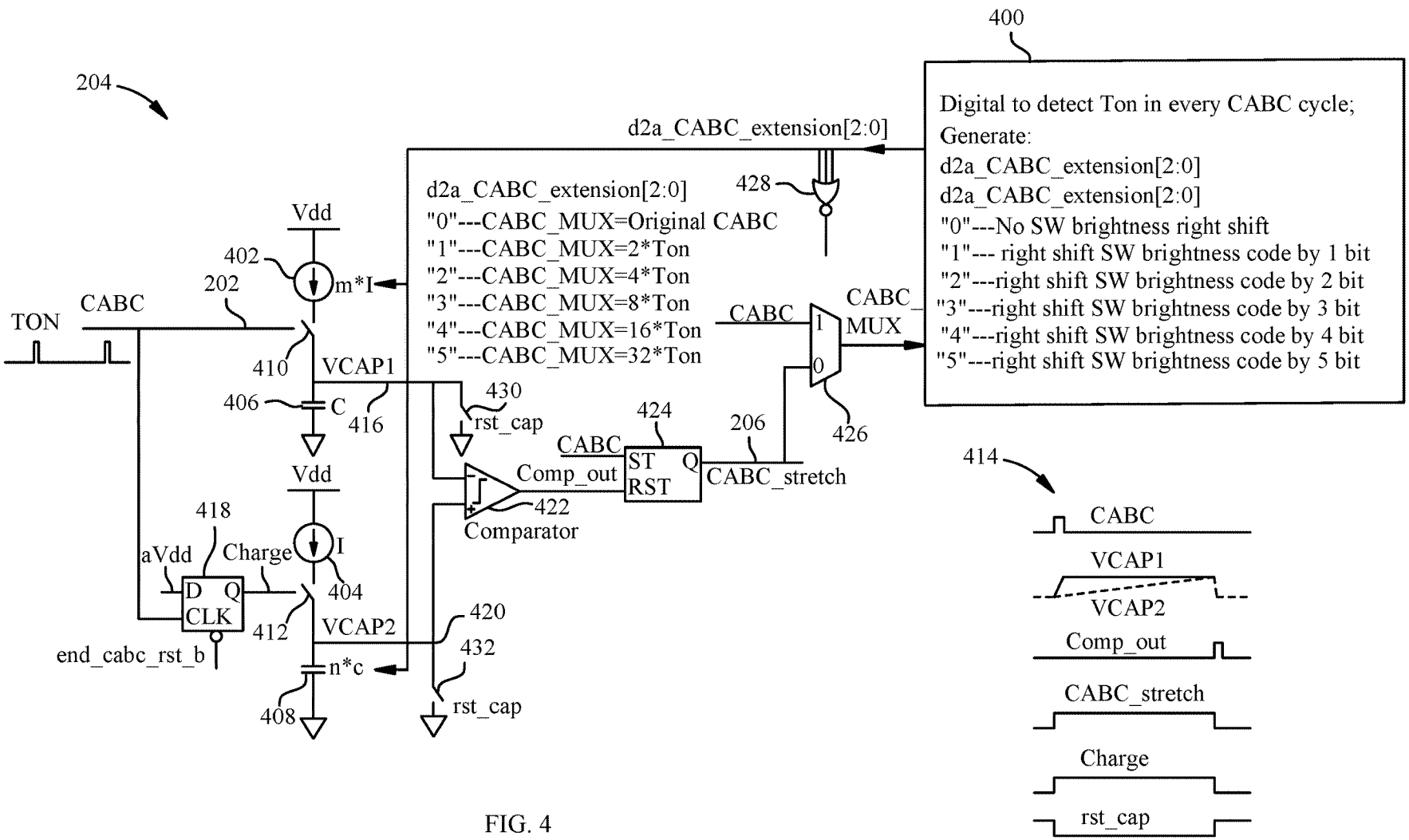
FIG. 4 illustrates an example implementation of a duty cycle adjustment circuit, in accordance with certain aspects of the present disclosure.

FIG. 4 illustrates an example implementation of the duty cycle adjustment circuit 204 and a digital processor 400 (e.g., including the digital processor 212 and the control circuit 302), in accordance with certain aspects of the present disclosure. As illustrated, the duty cycle adjustment circuit 204 includes current sources 402, 404, each selectively coupled to a respective one of capacitive elements 406, 408 via respective switches 410, 412. As illustrated, the switch 410 may be controlled via the CABC signal 202. For example, when the CABC signal 202 is logic high, the switch 410 may be closed, charging the capacitive element 406 having a capacitance C. As illustrated in timing diagram 414, the capacitor voltage (VCAP1) at node 416 increases while the CABC signal is logic high.

The CABC signal may also be provided to a clock (CLK) input of a D flip-flop 418, the data (D) input of the D flip-flop 418 being coupled to an analog voltage rail (aVdd). The output (Q) of the D flip-flop 418 may be used to control the switch 412. A charge signal (labeled "charge") may be generated at the output of the D flip-flop 418 that transitions to logic high at the rising edge of the CABC signal, and transitions back to logic low once the D flip-flop 418 is reset via a reset signal (end_cabc_rst_b), as illustrated by timing diagram 414. While the charge signal is logic high, the switch 412 is closed, charging the capacitive element 408. As illustrated in timing diagram 414, the capacitor voltage (VCAP2) at node 420 increases while the charge signal is logic high.

The capacitance of the capacitive element 406 may be less than the capacitance of the capacitive element 408, and the current source 402 may supply a greater current than the current source 404. For example, the current source 404 may supply a current I, and the current source 402 may supply a current m*I. Moreover, the capacitance of the capacitive element 406 may be C, and the capacitance of the capacitive element 408 may be n*C. m*n being a factor set by the digital processor 400 via a digital signal (labeled "d2*a*_CABC_extension"). For example, to achieve duty cycle adjustment factor of 8, m may be set to 4, then n may be set to 2. The d2*a*_CABC_extension signal may be a 3-bit signal. Therefore, as illustrated in timing diagram 414, VCAP1 increases relatively quickly while the CABC signal is logic high (closing switch 410), whereas VCAP2 increases relatively slowly while the charge signal is logic high (closing switch 412).

VCAP1 and VCAP2 are provided to inputs of a comparator 422. Once the voltage of VCAP2 reaches the voltage of VCAP1, the comparator output (comp_out) signal transitions to logic high, as illustrated in timing diagram 414.

As illustrated, the CABC signal may be provided to a set (ST) input of a set-reset (SR) flip-flop 424, and the comp_out signal may be provided to a reset (RST) input of the SR flip-flop 424. The CABC_stretch signal is generated at the output Q of the SR flip-flop 424. As illustrated in timing diagram 414, the CABC_stretch signal has a rising edge (e.g., logic state transitions to logic high) in response to the rising edge of the CABC signal, and has a falling edge (e.g., logic state transitions back to logic low) in response to a rising edge of the comp_out signal, in effect configuring a duty cycle of the CABC_stretch signal that is greater than the duty cycle of the CABC signal by a duty cycle adjustment factor that is set by the d2*a*_CABC_extension signal generated by the digital processor 400.

In some aspects, the CABC_stretch signal and the CABC signal are provided to inputs of a multiplexer 426. The multiplexer 426 may generate a CABC multiplexer (CABC_MUX) signal that may correspond to either the CABC_stretch signal or the CABC signal, based on an output of a NOR gate 428, the inputs of the NOR gate 428 receiving the individual bit lines of the d2*a*_CABC_extension signal. For example, if the digital processor 400 generates the d2*a*_CABC_extension signal having a digital value of 0, indicating that the CABC signal is not to be stretched, the output of the NOR gate may be logic high such that the CABC_MUX signal corresponds to the CABC signal. Otherwise, the CABC_MUX signal may correspond to the CABC_stretch signal. The CABC_MUX signal generated by the multiplexer 426 may correspond to the CABC signal 106 provided to the backlight control circuit 100 for controlling the brightness of the display, as described herein.

As illustrated, the CABC_MUX signal may be provided to the digital processor 400, allowing the digital processor to set the d2*a*_CABC_extension signal, as well as the SW brightness code, as described herein. For example, the digital processor 400 may set the d2*a*_CABC_extension signal to "0" in order for the CABC_MUX signal to correspond to the CABC signal (e.g., the original non-stretched version of the CABC signal), to "1" for the CABC_MUX signal to have an on time (Ton) (e.g., pulse width) that is equal to 2 times Ton of the CABC signal, to "2" for the CABC_MUX signal to have a Ton (e.g., pulse width) that is equal to 4 times the Ton of the CABC signal, and so on. The digital processor 400 may also set the SW brightness code accordingly. For example, the digital processor 400 may set the SW brightness code to "0" such that no SW brightness division is implemented, to "1" such that the SW brightness code is divided by 2 (e.g., right shifted by 1 bit), to "2" such that the SW brightness code is divided by 4 (e.g., right shifted by 2 bits), and so on.

In certain aspects, switches 430, 432 may be coupled in parallel with capacitive elements 406, 408, respectively. The switches 430, 432 may be controlled via a reset capacitor (rst_cap) signal, such that the switches 430, 432 are open starting from the rising edge of the CABC signal until the rising edge of the comp_out signal, and closed otherwise. When the switches 430, 432 are closed, the capacitive elements 406, 408 are discharged, allowing for further CABC stretching operations.

Figure 5:
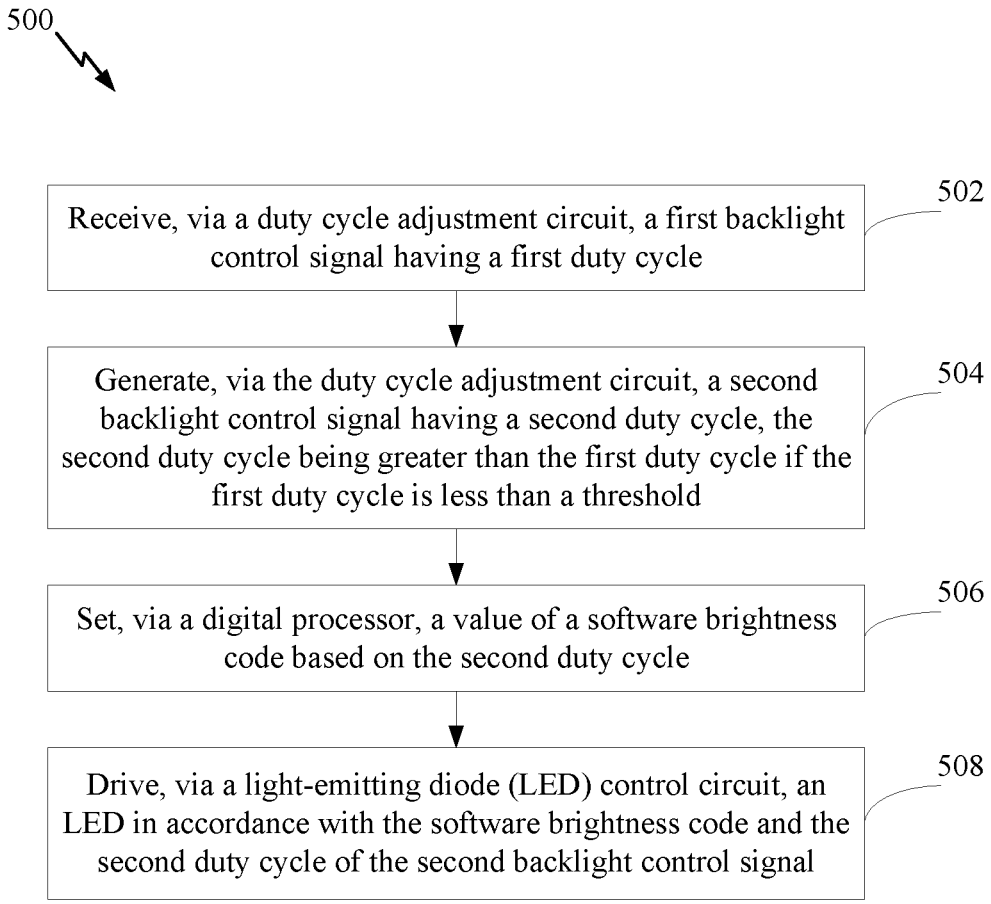
FIG. 5 is a flow diagram of example operations for brightness control, in accordance with certain aspects of the present disclosure.

FIG. 5 is a flow diagram of example operations 500 for brightness control, in accordance with certain aspects of the present disclosure. The operations 500 may be performed by a control system, such as the backlight control circuit 100, the duty cycle adjustment circuit 204, and the digital processor 400.

The operations 500 may begin, at block 502, with the control system receiving, at a duty cycle adjustment circuit (e.g., duty cycle adjustment circuit 204), a first backlight control signal (e.g., CABC signal) having a first duty cycle. At block 504, the control system generates, via the duty cycle adjustment circuit, a second backlight control signal (e.g., CABC_MUX signal, or CABC_stretch signal) having a second duty cycle, the second duty cycle being greater than the first duty cycle if the first duty cycle is less than a threshold (e.g., TH1). At block 506, the control system sets, via a digital processor (e.g., digital processor 400), a value of a software brightness code (e.g., SW brightness code 208) based on the second duty cycle, and at block 508, drives, via a backlight control circuit (e.g., backlight control circuit 100), a backlight in accordance with the software brightness code and the second duty cycle of the second backlight control signal.

In certain aspects, the control system may also determine, via the digital processor, the first duty cycle of the first backlight control signal, and set, via the digital processor, a duty cycle adjustment factor based on the first duty cycle. Generating the second backlight control signal may include applying the duty cycle adjustment factor to the first backlight control signal. In some aspects, setting the duty cycle adjustment factor may include increasing, via the digital processor, the duty cycle adjustment factor if the first duty cycle is less than the threshold, and decreasing the duty cycle adjustment factor if the first duty cycle is greater than another threshold. In certain aspects, setting the value of the software brightness code may include dividing an input software brightness code (e.g., SW brightness code 210) by a code adjustment factor, the code adjustment factor corresponding to the duty cycle adjustment factor.

In certain aspects, the control system may selectively provide, via a multiplexer (e.g., multiplexer 426), one of the first backlight control signal and the second backlight control signal to the backlight control circuit. For example, the operations 500 may include the control system determining, via the digital processor, whether the first duty cycle is less than the threshold, and controlling, via the digital processor, the multiplexer to provide the second backlight control signal to the backlight control circuit if the first duty cycle is less than the threshold.

The various operations of methods described above may be performed by any suitable means capable of performing the corresponding functions. The means may include various hardware and/or module(s), including, but not limited to a circuit, an application-specific integrated circuit (ASIC), or processor. Generally, where there are operations illustrated in figures, those operations may have corresponding counterpart means-plus-function components with similar numbering. For example, means for receiving and means for generating may include a duty cycle adjustment circuit, such as the duty cycle adjustment circuit 204, means for setting may include a digital processor, such as the digital processor 400, and means for driving may include a backlight control circuit, such as the backlight control circuit 100.

As used herein, the term "determining" encompasses a wide variety of actions. For example, "determining" may include calculating, computing, processing, deriving, investigating, looking up (e.g., looking up in a table, a database, or another data structure), ascertaining, and the like. Also, "determining" may include receiving (e.g., receiving information), accessing (e.g., accessing data in a memory), and the like. In addition, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The various illustrative logical blocks, modules and circuits described in connection with the present disclosure may be implemented or performed with a general purpose processor, a digital signal processor (DSP), an ASIC, a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. A circuit for brightness control, comprising:

a duty cycle adjustment circuit configured to:

receive a first backlight control signal having a first duty cycle; and generate a second backlight control signal having a second duty cycle by applying a duty cycle adjustment factor to the first backlight control signal, the second duty cycle being greater than the first duty cycle when the first duty cycle is less than a threshold;

a digital processor configured to set a value of a software brightness code by dividing an input software brightness code by a code adjustment factor, a value of the code adjustment factor being equal to a value of the duty cycle adjustment factor; and a backlight control circuit configured to drive a backlight in accordance with the software brightness code and the second duty cycle of the second backlight control signal.

2. The circuit of claim 1, wherein the digital processor is further configured to:

determine the first duty cycle of the first backlight control signal; and set the duty cycle adjustment factor based on the first duty cycle.

3. The circuit of claim 2, wherein the digital processor is configured to:

increase the duty cycle adjustment factor if the first duty cycle is less than the threshold; and decrease the duty cycle adjustment factor if the first duty cycle is greater than another threshold.

4. The circuit of claim 2, wherein the duty cycle adjustment circuit comprises:

a first current source;

a first capacitive element;

a first switch configured to selectively couple the first current source to the first capacitive element based on the first backlight control signal;

a second current source;

a second capacitive element; and a second switch configured to couple the second current source to the second capacitive element in response to a rising edge of the first backlight control signal.

5. The circuit of claim 4, wherein the digital processor is configured to set the duty cycle adjustment factor by at least one of:

controlling a capacitance of the second capacitive element; or setting an amount of current sourced by the first current source.

6. The circuit of claim 4, wherein a capacitance of the second capacitive element is equal to or greater than a capacitance of the first capacitive element.

7. The circuit of claim 4, wherein the first current source is configured to source an equal or greater current than the second current source.

8. The circuit of claim 4, further comprising a comparator having a first input coupled to a first node between the first switch and the first capacitive element, and a second input coupled to a second node between the second switch and the second capacitive element, wherein a falling edge of the second backlight control signal corresponds to a logic state transition of an output signal of the comparator.

9. The circuit of claim 8, wherein the duty cycle adjustment circuit further comprises:

a set-reset (SR) flip-flop having a set input configured to receive the first backlight control signal, a reset input configured to receive the output signal of the comparator, and an output configured to generate the second backlight control signal.

10. The circuit of claim 4, wherein the duty cycle adjustment circuit further comprises:

a third switch in parallel with the first capacitive element; and a fourth switch in parallel with the second capacitive element, the third switch and the fourth switch being closed when the first switch and the second switch are open to discharge the first capacitive element and the second capacitive element, respectively.

11. The circuit of claim 1, further comprising a multiplexer configured to:

receive the first backlight control signal and the second backlight control signal; and selectively provide one of the first backlight control signal and the second backlight control signal to the backlight control circuit.

12. The circuit of claim 11, wherein the digital processor is further configured to:

determine whether the first duty cycle is less than the threshold; and control the multiplexer to provide the second backlight control signal to the backlight control circuit if the first duty cycle is less than the threshold.

13. The circuit of claim 1, wherein the backlight control circuit is configured to sample the second backlight control signal using a sampling signal, the sampling signal having a higher frequency than the second backlight control signal, and wherein the sampling signal and the second backlight control signal are unsynchronized.

14. A method for brightness control, comprising:

receiving, at a duty cycle adjustment circuit, a first backlight control signal having a first duty cycle;

generating, via the duty cycle adjustment circuit, a second backlight control signal having a second duty cycle by applying a duty cycle adjustment factor to the first backlight control signal, the second duty cycle being greater than the first duty cycle when the first duty cycle is less than a threshold;

setting, via a digital processor, a value of a software brightness code by dividing an input software brightness code by a code adjustment factor, a value of the code adjustment factor being equal to a value of the duty cycle adjustment factor; and driving, via a backlight control circuit, a backlight in accordance with the software brightness code and the second duty cycle of the second backlight control signal.

15. The method of claim 14, further comprising:

determining, via the digital processor, the first duty cycle of the first backlight control signal; and setting, via the digital processor, the duty cycle adjustment factor based on the first duty cycle.

16. The method of claim 15, wherein setting the duty cycle adjustment factor comprises:

increasing the duty cycle adjustment factor if the first duty cycle is less than the threshold; and decreasing the duty cycle adjustment factor if the first duty cycle is greater than another threshold.

17. The method of claim 14, further comprising selectively providing, via a multiplexer, one of the first backlight control signal and the second backlight control signal to the backlight control circuit.

18. A circuit for brightness control, comprising:

a duty cycle adjustment circuit comprising:

a first current source;

a first capacitive element;

a first switch configured to selectively couple the first current source to the first capacitive element based on a first backlight control signal;

a second current source;

a second capacitive element; and a second switch configured to couple the second current source to the second capacitive element in response to a rising edge of the first backlight control signal, wherein the duty cycle adjustment circuit is configured to:

receive the first backlight control signal having a first duty cycle; and generate a second backlight control signal having a second duty cycle, the second duty cycle being greater than the first duty cycle when the first duty cycle is less than a threshold;

a digital processor configured to set a value of a software brightness code based on the second duty cycle; and a backlight control circuit configured to drive a backlight in accordance with the software brightness code and the second duty cycle of the second backlight control signal.

19. The circuit of claim 18, wherein a capacitance of the second capacitive element is equal to or greater than a capacitance of the first capacitive element.

20. The circuit of claim 18, further comprising a comparator having a first input coupled to a first node between the first switch and the first capacitive element and having a second input coupled to a second node between the second switch and the second capacitive element, wherein a falling edge of the second backlight control signal corresponds to a logic state transition of an output signal of the comparator.

* * * * *